US005666606A

United States Patent [19]

Okano et al.

[11] Patent Number: 5,666,606

[45] Date of Patent: Sep. 9, 1997

[54] IMAGE FORMING APPARATUS COMPRISING CONTACT TYPE CHARGING MEMBER

[75] Inventors: Keiji Okano, Tokyo; Takahiro Inoue, Yokohama; Kazushige Sakurai, Kawasaki; Tadashi Onimura, Tokyo; Kouichi Suwa, Yokohama; Masaki Ojima, Inagi; Hiroshi Sato, Tokyo; Seiji Yamaguchi, Tokyo; Hideki Matsumoto, Tokyo, all of Japan

[73] Assignee: Canon Kabushiki Kaisha, Tokyo, Japan

[21] Appl. No.: 658,530

[22] Filed: Jun. 5, 1996

[30] Foreign Application Priority Data

Jun. 8, 1995 [JP] Japan ..... 7-166924

[51] Int. Cl.[6] ..... G03G 15/02

[52] U.S. Cl. ..... 399/174; 361/225

[58] Field of Search ..... 399/168, 174, 399/176, 116; 361/225, 230

[56] References Cited

U.S. PATENT DOCUMENTS

| | | | |
|---|---|---|---|
| 4,851,960 | 7/1989 | Nakamura et al. | 399/168 X |
| 5,146,280 | 9/1992 | Kisu | 399/176 |
| 5,436,701 | 7/1995 | Shomojo et al. | 399/174 |
| 5,475,471 | 12/1995 | Kisu et al. | 399/168 X |
| 5,485,248 | 1/1996 | Yano et al. | 399/168 X |

FOREIGN PATENT DOCUMENTS

| | | |
|---|---|---|
| 0272072 | 6/1988 | European Pat. Off. . |
| 0643339 | 9/1993 | European Pat. Off. . |
| 0636949 | 2/1995 | European Pat. Off. . |
| 0690352 | 1/1996 | European Pat. Off. . |
| 63-149669 | 6/1988 | Japan . |
| 3-188456 | 8/1991 | Japan . |
| 6-19175 | 1/1994 | Japan . |
| 6-35220 | 2/1994 | Japan . |

*Primary Examiner*—Shuk Lee

*Attorney, Agent, or Firm*—Fitzpatrick, Cella, Harper & Scinto

[57] ABSTRACT

An image forming apparatus includes a image bearing member having a photosensitive layer, a surface protection layer having fluorine resin material; a charging member contactable to the image bearing member to electrically charge the image bearing member, the charging member is capable of being supplied with an oscillation voltage, and wherein a peak-to-peak voltage of the oscillating voltage applied across a gap between a surface of the charging member and the surface of the image bearing member, is not less than twice a charge starting voltage of the image bearing member in the gap and not more than 1600 volt.

10 Claims, 10 Drawing Sheets

$$E_1/R_1+C_1\frac{dE_1}{dt}=E_2/R_2+C_2\frac{dE_2}{dt}$$

$$E_1/R_1+C_1\frac{dE_1}{dt}=C_3\frac{dE_3}{dt}$$

$$E_1+E_2+E_3=E_o$$

$$RI = \frac{I}{V} \qquad CI = \frac{\sqrt{2}\,Iac}{\pi f Vpp}$$

FIG. 7A

FILM THICKNESS = 13 μm

| W (V) | 1000 | 1100 | 1200 | 1300 | 1400 | 1500 | 1600 | 1700 | 1800 |
|---|---|---|---|---|---|---|---|---|---|
| IMAGE FLOW | O | O | O | O | O | O | Δ | × | × |
| FOG | × | O | O | O | O | O | O | O | O |

A

FIG. 7B

FILM THICKNESS = 20 μm

| W (V) | 1000 | 1100 | 1200 | 1300 | 1400 | 1500 | 1600 | 1700 | 1800 |
|---|---|---|---|---|---|---|---|---|---|
| IMAGE FLOW | O | O | O | O | O | O | Δ | × | × |
| FOG | × | × | O | O | O | O | O | O | O |

A

FIG. 7C

FILM THICKNESS = 25 μm

| W (V) | 1000 | 1100 | 1200 | 1300 | 1400 | 1500 | 1600 | 1700 | 1800 |
|---|---|---|---|---|---|---|---|---|---|
| IMAGE FLOW | O | O | O | O | O | O | Δ | × | × |
| FOG | × | × | × | O | O | O | O | O | O |

A

A: RANGE WHEREIN BOTH ARE SATSFIED $|\vec{V_C}| = 1.5 \times |\vec{V_D}|$ $|\vec{V_C}| = 0.5 \times |\vec{V_D}|$

IMAGE FORMING APPARATUS COMPRISING CONTACT TYPE CHARGING MEMBER

FIELD OF THE INVENTION AND RELATED ART

The present invention relates to an image forming apparatus comprising an image bearing member, and a charging member for charging the image bearing member, wherein the image bearing member is charged or discharged as a voltage composed of an AC voltage component and a DC voltage component is applied to the charging member placed in contact with the image bearing member.

A contact type charging apparatus has been put to practical use as a means for charging an image bearing member such as an electrophotographic photosensitive member, an electrostatic dielectric member, and the like, in an image forming apparatus such as an electro-photographic apparatus or an electrostatic recording apparatus. This is because the contact type system, which charges the image bearing member as a voltage is applied to the charging member placed in contact with the image bearing member, is characterized in that compared to a corona type charging system, which is a noncontact type system, the contact type system allows power source voltage to be reduced, is less expensive, and generates a smaller amount of ozone.

FIG. 14 illustrates one of the contact type charging apparatuses such as the above described one.

A reference numeral 101 designates a rotary drum type electro-photographic photosensitive member (hereinafter, photosensitive drum), and is rotatively driven in the clockwise direction indicated by an arrow mark. Basically, this photosensitive drum 101 comprises an electrically conductive base member 101*a* of aluminum or the like in the form of a drum, and an organic photosensitive member 101*b* disposed on the peripheral surface of the base member 101*a*.

A reference numeral 102 designates a charge roller as the contact type charging member. The charge roller 102 in this drawing comprises a metallic core 102*a*, an electrically conductive rubber roller portion 102*b* disposed on the peripheral surface of the metallic core 102*a*, and a high resistance layer 102*c* covering the rubber roller portion 102*b*. The charge roller 102 is placed in contact with the surface of the photosensitive drum 101 with a predetermined contact pressure, and is rotated by the rotation of the photosensitive drum 101.

A reference numeral 103 designates a power source from which voltage is applied to the charge roller 102. As a predetermined voltage is applied from this power source 103 to the charge roller 102 which is in contact with the photosensitive drum, the surface of the photosensitive drum is charged to a predetermined potential level.

Around the photosensitive drum 101 or in the vicinity thereof, various devices other than the photosensitive drum 101, which are necessary for an image forming process, are disposed to constitute an image forming system. However, these devices are not illustrated in the drawing.

As for the contact type charging system, there are two types: a DC type charge system and an AC type charge system. In the case of the former, only a DC voltage is applied to the charging member to charge the member to be charged, and in the case of the latter, a voltage (oscillating voltage: voltage whose value periodically changes with time) composed of an AC voltage component and a DC voltage component is applied to charge the member to be charged.

(a) DC type charge system

As the DC voltage applied to the charge roller 102 as the contact type charging member is gradually increased/the image bearing member (member to be charged) begins to be charged when the value of the applied voltage reaches a predetermined value. This voltage value, at which the member to be charged begins to be charged when a DC voltage is applied to the contact type charging member, is the charge start voltage, which will be designated by $V_{th}$. Above the charge start voltage $V_{th}$, the potential $V_d$ to which the surface of the member to be charged is charged is proportional to the applied DC voltage. Therefore, in order to charge the photosensitive drum 101 to a predetermined surface potential $V_d$, it is only necessary to apply to the charge roller 102, a DC voltage ($V_d$+$V_{th}$), that is, the sum of the desired surface potential $V_d$ and the charge start voltage value $V_{th}$ of the photosensitive drum. A charging system such as the one described above in which only a DC voltage is applied to the charging member in order to charge the member to be charged is designated as "DC charging system".

In the case of the DC charging system, dust or the like contaminant adhering to the surface of the charge roller 102 as the contact type charging member, or damage to the surface thereof, is liable to effect nonuniform surface potential on the photosensitive drum surface. In addition, the DC charging system has poor convergence in terms of microscopic potential, which is liable to generate a slightly foggy image.

(b) AC charging system

As for a method for improving the uniformity of the charge potential, there is a method in which the member to be charged is charged by applying a DC voltage component equivalent to the desired surface potential $V_d$, and an AC voltage component having a peak-to-peak voltage $V_{pp}$ twice the charge start voltage value $V_{th}$ of the image bearing member, that is, the member to be charged (Japanese Laid-Open Patent Application No. 149,6691/1988).

As a voltage composed of the DC voltage component ($V_d$) and the AC voltage component is applied to the charge roller 102 as the charging member, the potential of the photosensitive surface of the photosensitive drum 101 as the image bearing member oscillates, but the average value thereof remains at the voltage $V_d$. Therefore, the nonuniformity caused by the oscillation of the potential can be practically eliminated by increasing the frequency of the AC voltage component. Further, in comparison to the DC charge system, the AC charge system is superior in the convergence and stability of the charge potential, and also can remarkably uniformly charge the member to be charged, even when there are microscopic irregularities on the charge roller surface or contaminant adheres to the charge roller.

(c) Image bearing member

A reference numeral 101*b* designates the photosensitive portion 101*b* of the image bearing member. It is composed of an organic photosensitive material, wherein its surface layer (hereinafter, protection layer) contains electrically conductive particles, and resin particles containing fluorine atoms, affording a small surface friction coefficient μ, and superiority in mold releasing properties, wear resistance, and scratch resistance. Since this photosensitive portion has a small surface friction coefficient μ, it has merits in that the surface of the image bearing member can be preferably cleaned of the toner remaining thereon after image transfer (post-image transfer residual toner); the torque required to rotate the photosensitive drum can be reduced; and pitch irregularities can be reduced. Further, the amount of the shaving which occurs to the photosensitive portion is small, giving a long service life to the photosensitive drum, which in turn contributes to cost reduction and low maintenance.

A method for charging a photosensitive-drum such as the one described in the foregoing using the DC charge system or the AC charge system is proposed in Japanese Laid-Open Patent Application No. 35,220/1994.

After each image transfer, loose contaminants such as the post-transfer residual toner or paper dust remaining on the surface of the photosensitive drum as the image bearing member are removed by a cleaning means, and then, the cleaned photosensitive drum is subjected to the next image formation. However, some of the contaminants, such as the products resulting from the electrical discharge which occurs during the charging process or the residue from the transfer material, fail to be cleaned by the cleaning means, gradually contaminating the surface of the photosensitive drum. As the surface of the photosensitive portion is contaminated, the resistance thereof is reduced, causing the electrostatic latent image to be disturbed, or the toner or the toner ingredients to fuse to the surface of the photosensitive portion, deteriorating the image quality. On the other hand, recently, the public has been demanding an image forming apparatus such as a laser printer to provide higher image quality. For example, resolution is expected to reach as high as 600 dpi to 800 dpi, and also, the imaging process is advancing toward multi-value imaging in which an imaging process such as PWM (pulse width modulation) is employed. As a result, even a slight contamination on the surface of the photosensitive portion manifests on the finished image.

Therefore, the surface of the photosensitive portion is positively, though slightly, polished (shaved) off with a cleaning blade, or a polishing agent or the like added to the developer, so that the surface of the photosensitive portion is refreshed to continuously produce preferable images.

However, a photosensitive portion such as the one described in the preceding paragraph (c), which has a small surface friction coefficient μ, and is superior in mold releasing properties, wear resistance, and scratch resistance, is characteristically difficult to shave with the cleaning blade due to its small surface friction coefficient μ; therefore, once the products from electrical discharge which occurs during the charging process adheres to the surface, they are difficult to remove. Further, the electrically conductive particles are contained in the surface protective layer; therefore, the surface resistance tends to be low. When an image bearing member with a low surface resistance is used in a high humidity environment, the products from the electrical discharge, which adhere to the surface, are liable to absorb moisture, causing the electrostatic latent image formed on the photosensitive portion to flow (drift) into the surrounding areas, which results in flow of an image or a blurred image.

In the case of the charging by contact (hereinafter, contact charge), the amount of electrical discharge, which occurs while the image bearing member is charged, is smaller, producing a proportionally smaller amount of ozone, than in the case of the corona type charging apparatus. However, the ozone is generated in the microscopic gaps between the photosensitive portion and the charge roller; therefore, even though the ozone is generated by a smaller amount, it still adheres to the surface of the photosensitive portion, deteriorating the potential maintaining capacity of the surface of the photosensitive portion, which is liable to result in an image flow or a blurred image.

That is, when the photosensitive portion described above is charged using the contact type charging member, the products from the electrical discharge adhere to the surface of the photosensitive portion. However, the surface of the photosensitive portion has a low friction coefficient μ, and is hard; therefore, it is difficult to shave, making it difficult for the surface to be cleaned of the products which are produced through the electrical discharge and are adhering to the surface of the photosensitive portion. Further, the surface resistance of the photosensitive portion is naturally low, and the products from the electrical discharge, which adhere to the surface of the photosensitive portion, and are difficult to remove, are liable to absorb moisture in a high humidity environment, and therefore, are liable to cause the image to flow or blur. In addition, the AC discharge system increases the discharge current, being liable to produce the image flow or the blurred image.

SUMMARY OF THE INVENTION

Accordingly, the primary object of the present invention is to provide an image forming apparatus capable of preventing the image flowing or image blurring.

Another object of the present invention is to provide an image forming apparatus capable of reducing the charge current induced by the charging member.

Another object of the present invention is to provide an image forming apparatus employing a wear resistant image bearing member.

Another object of the present invention is to provide an image forming apparatus employing a contact type charging member capable of uniformly charging the image bearing member.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 4 is an equivalent circuit pertaining to the photosensitive drum, the charging roller, a power source, and the like.

FIGS. 7(*a*), 7(*b*) and 7(*c*) are tables showing the relationship between the peak-to-peak voltage of the applied AC, and the image characteristics.

DETAILED DESCRIPTION OF THE PREFERRED EMBODIMENTS

Embodiment 1 (FIGS. 1–8)

(1) Image forming apparatus

Figure 1:
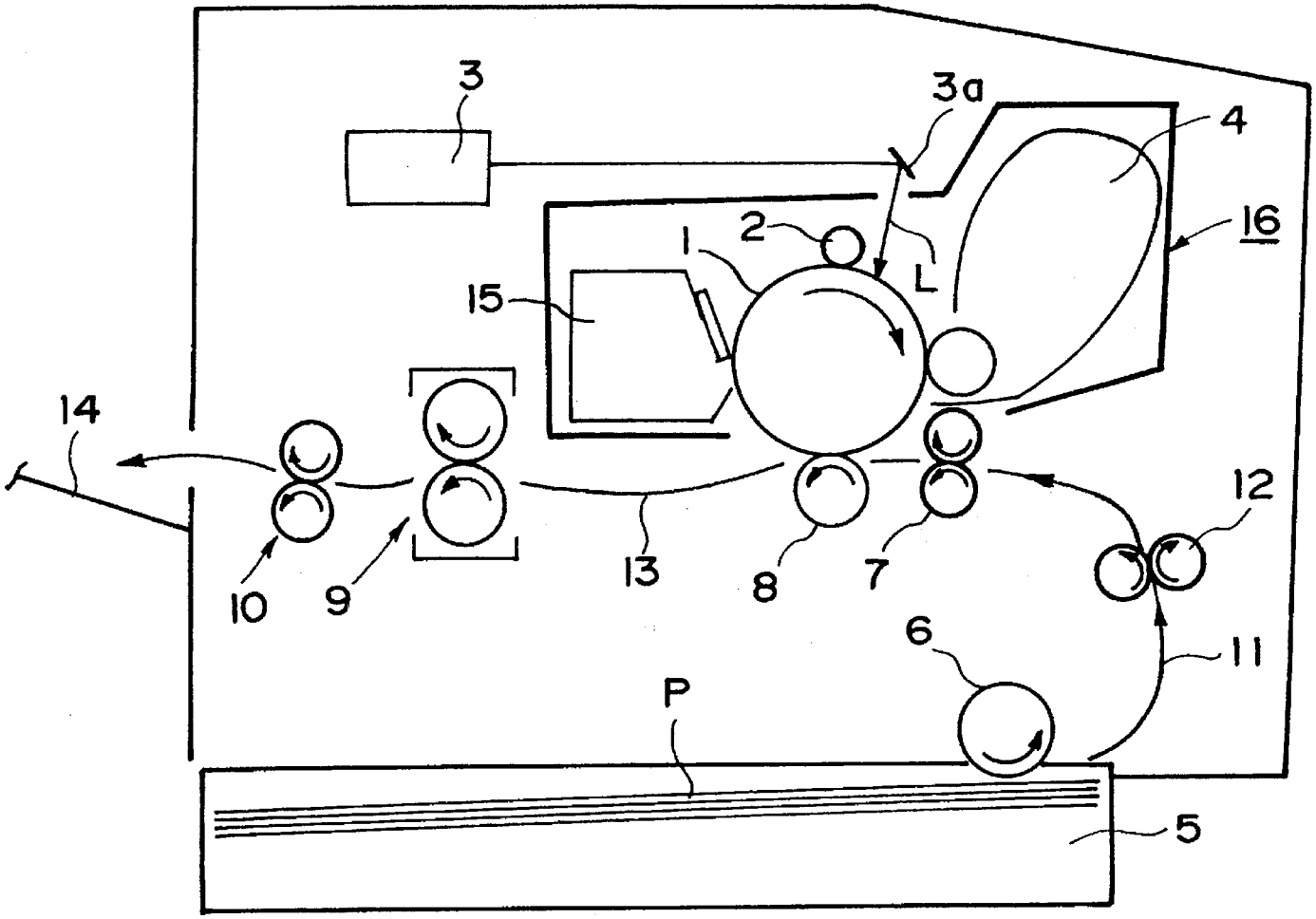
FIG. 1 is a schematic section of the structure of a typical image forming apparatus.

FIG. 1 is a schematic section of a typical image forming apparatus in accordance with the present invention. This image forming apparatus is a laser beam printer based on an image transfer type electrophotographic process, and employs a removably installable process cassette.

A reference numeral 1 designates an electrophotographic photosensitive member (photosensitive drum) in the form of a rotary drum, and is rotatively driven in the clockwise direction indicated by an arrow mark at a peripheral speed of 100 mm/sec. photosensitive portion of this photosensitive drum comprises a protective layer, that is, the surface layer, with a low friction coefficient of μ, and an OPC layer. The laminar structure of the photosensitive portion, which comprises these layers, will be described later.

A reference numeral 2 designates a charge roller as the contact type charging member. It is disposed in contact with the surface of the photosensitive drum 1, maintaining a predetermined contact pressure. In this embodiment, it rotates following the rotation of the photosensitive drum 1. The laminar structure of this charge roller 2 will be also described later.

The rotary photosensitive drum 1 is uniformly charged to a predetermined polarity and a predetermined potential level by the charge roller. The uniformly charged surface of the rotary photosensitive drum 1 is exposed to a scanning laser beam L projected from a laser scanner 3 which modulates the laser beam L in response to electric digital signals reflecting the data of a target image (exposure by raster scanning); the laser beam emitted from the semiconductor laser of the laser scanner 3 is focused on the photosensitive drum 1 through an optical system, whereby an electrostatic latent image reflecting the data of the target image is formed on the surface of the rotary photosensitive drum 1. A reference numeral 3*a* designates a mirror for deflecting the laser beam.

The electrostatic latent image formed on the surface of the rotary photosensitive drum 1 is developed with the toner, in the developing device 4. As for the developing method, the jumping development, the two components (toner and carrier) development, the FEED development, or the like, is employed. It is preferable that the image exposure process, in which the charges of the latent image portions on which the toner is to be adhered are caused to attenuate by the exposure to the laser beam, is used in combination with the reverse development which adheres the toner to the areas having a reduced charge.

The toner image formed through the development process is moved to a transfer portion, that is, a pressure nip formed between the photosensitive drum i and a transfer roller 8 as a transferring means. Meanwhile, a transfer material P as a recording medium stored in a sheet feeder cassette 5 is delivered to the transfer portion in synchronism with the imaging signals, through a sheet delivery path comprising a sheet feeder roller 6, a sheet path 11, a conveyer roller 12, and a timing roller 7, which are driven in response to the print signals sent from a host apparatus. In the transfer portion, the toner image is sequentially transferred from one end to the other onto the surface of the synchronously delivered transfer material P. The transfer roller 8 is an electrically conductive elastic member which is low in hardness. As a transfer bias whose charge polarity is opposite to that of the toner is applied to this charge roller 8, the toner image on the surface of the photosensitive drum 1 is electrostatically transferred onto the surface of the transfer material P.

The transfer material P having passed through the transfer portion is separated from the surface of the photosensitive drum 1, sent through a sheet guide 13, introduced into a fixing device 9, in which the toner image is fixed to the transfer material P. Thereafter, it is discharged by a sheet discharge roller 10, into an external sheet catcher tray 14.

Meanwhile, after the toner image is transferred onto the transfer material P, contaminants such as the post-transfer residual toner adhering to the surface of the photosensitive drum 1 are removed by the cleaning blade, and then; the cleaned photosensitive drum 1 is subjected to the next image formation.

The printer in this embodiment employs a process cartridge.16 which is removably installable in the main assembly of the printer. The process cartridge 16 comprises four processing devices: the photosensitive drum 1, the charge roller 2, the developing device 4, and a cleaner 15. The employment of the process cartridge improves the operational efficiency of the printer, and also makes the printer easier to maintain; for example, jammed transfer material can be recovered by removing the process cartridge. The power source 30 of the charge roller 2 is provided on the main assembly side of the printer.

(2) Photosensitive drum 1

Figure 2:
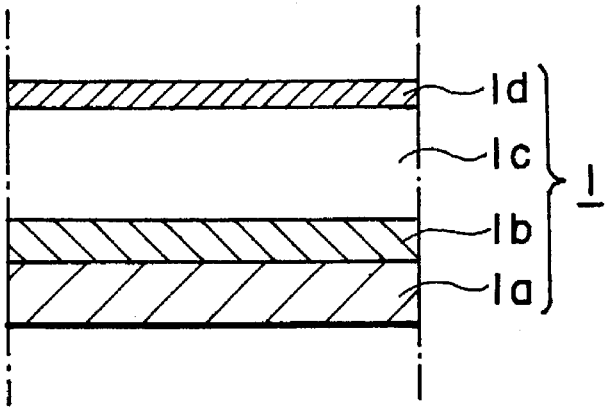
FIG. 2 is a schematic section of the laminar structure of the photosensitive drum.

FIG. 2 is a schematic section of the laminar structure of the photosensitive drum 1 as the image bearing member. The photosensitive drum 1 comprises a base member 1*a* in the form of a drum, a charge carrier layer 1*b*, a charge transfer layer 1*c*, and a surface protection layer 1*d*. The base member 1*a* is composed of metallic material such as aluminum, chrome, nickel, copper, or stainless steel, and these layers 1*b*, 1*c* and 1*d* constitute an OPC, and are laminated on the peripheral surface of the base member 1 in the order of layers 1*b*, 1*c*, and 1*d* from the bottom. The electrically conductive base member 1*a* may be formed of metallic material in the sheet form, or laminate material composed of metallic foil and plastic film.

(a) Charge carrier layer 1*b*

The charge carrier layer 1*b* is formed by coating the mixture of a binding resin material and a charge carrier material, or by vacuum depositing the charge carrier material, on the peripheral surface of the base member 1*b*. As for the charge carrier materials, azo pigments such as Sudan red or Diane blue; quinone pigment such as pyrenequinone or anthrone; quinocyanine pigment; indigo pigment such as perylene resin, indigo, or thioindigo; phthalocyanine pigment such as copper phthalocyanine or titanium phthalocyanine; or azulenium salt pigment, may be employed. As for the binding resin, polyvinylbutyral, polystyrene, polyvinyl acetate, acrylic resin, or ethylcellulose, may be employed.

The thickness of the charge carrier layer 1*b* is preferred to be no more than 5 μm, more preferably, in a range of 0.05–3.00 μm.

(b) Charge transfer layer 1*c*

The charge transfer layer 1*c* is formed of a mixture of a charge transfer material and a film forming resin. As for the charge transfer material, polycyclic aromatic compound whose principal or side chain is constituted of a structure such as biphenylene, anthracene, pyrene, or phenanthrene; nitrogen containing cyclic compound such as indole, carbazole, oxadiazole or pyrazoline; hydrazone compound; and styryl compound, are available.

As for the film forming resin, polyester, polycarbonate, polystyrene, polymethacrylester, and the like can be listed.

The thickness of the charge transfer layer 1*c* is in a range of 5–20 μm, preferably, in a range of 5–15 μm.

Further, the charge transfer layer may be formed of a single charge transfer material, or a mixture of charge transfer materials.

(c) Protection layer 1*d*

The protection layer 1*d* is a layer covering the photosensitive layer to protect it. It contains electrically conductive particles, resin particles containing fluorine atoms, and binder resin.

1) As for the electrically conductive micro-particle, microscopic metal powder, metallic oxide particle, carbon black, or the like, is employed, but transparent metallic oxide powder is preferable.

The preferable metallic oxides are zinc oxide, titanium oxide, tin oxide, antimony oxide, indium oxide, bismuth oxide, indium oxide doped with tin, tin oxide doped with antimony, zirconium oxide doped with antimony, or the like.

These metallic oxides may be employed alone, or two or more may be employed in combination. When employed in combination, they may be in a state of simple mixture, in a state of solid solution, or in a fused state.

In order to prevent the scattering of light, the diameters of these electrically conductive microparticles are preferred to be no more than 0.3 μm, more preferably, no more than 0.1 μm.

2) As for the resin particle material containing fluorine atoms, it is preferred to be selected from the following materials: tetrafluoroethylene resin, trifluoroethylene chloride resin, hexafluoroethylene-propylene resin, vinyl fluoride resin, polyvinylidene fluoride resin, bifluoroethylene chloride resin, or copolymer of the preceding materials. They may be employed alone or may be employed in combination of two or more. Tetrafluoroethylene resin, and vinylidene fluoride resin, are most preferable.

The molecular weight of the resin particle material, or the particle diameter may he optionally selected; there is no specific restriction.

The weight ratio of these compounds containing fluorine atoms, relative to the weight of the electrically conductive material, is preferred to be in a range of 1–100 wt. %, in particular, 5–50 wt. %.

3) As for the binding resin, polycarbonate resin, polyester, polyallylate resin, polystyrene resin, polyethylene resin, polypropylene resin, polyurethane resin, acrylic resin, epoxy resin, silicone resin, cellulose resin, polyvinyl chloride resin, phosphazene resin, melamine resin, vinyl chloride-vinyl acetate copolymer, and the like, can be listed.

These resin materials may be employed alone, or in combination of two or more.

The volumetric resistivity of the protection layer 1*d* is preferred to be in a range of $10^{10}$–$10^{14}$ Ω.cm.

The ratio of the amount of resin particles containing fluorine atoms, in the protection layer 1*d*, is preferred to be in a range of 5–70 wt. % relative to the total weight of the protection layer, more preferably, in a range of 10–60 wt. %.

When the ratio of the amount of the resin particles containing fluorine atoms is no less than 70 wt. %, the mechanical strength of the protection layer is liable to be reduced, but when it is no more than 5 wt. %, the mold releasing properties, the wear resistance, and the scratch resistance, of the protection layer surface may become insufficient.

In order to further improve. dispersibility, binding properties, and weather resistance, additives such as radical supplementing agents, antioxidants, or the like, may be employed.

The thickness of the protection layer 1*d* is preferred to be in a range of 0.2–10.0 μm, more preferably, in a range of 0.5–6.0 μm.

In this embodiment, the overall thickness of the dielectric layer (charge transfer layer plus protection layer) of the photosensitive portion of the photosensitive drum was 13 μm, the charge transfer layer being 10 μm thick, and the protection layer being 3 μm.

Also in this embodiment, the surface layer of the photosensitive drum 1 as the image bearing member is constituted of the protection layer 1*d* containing the electrically conductive particles and the resin particles containing fluorine atoms; therefore, the surface friction coefficient μ was small and was superior in mold releasing properties, wear resistance, and scratch resistance. It should be noted here that the contact angle of the protection layer 1*d* relative to water is preferred to be no less than 90°, more preferably, no less than 95°.

(3) Charge roller 2

Figure 3:
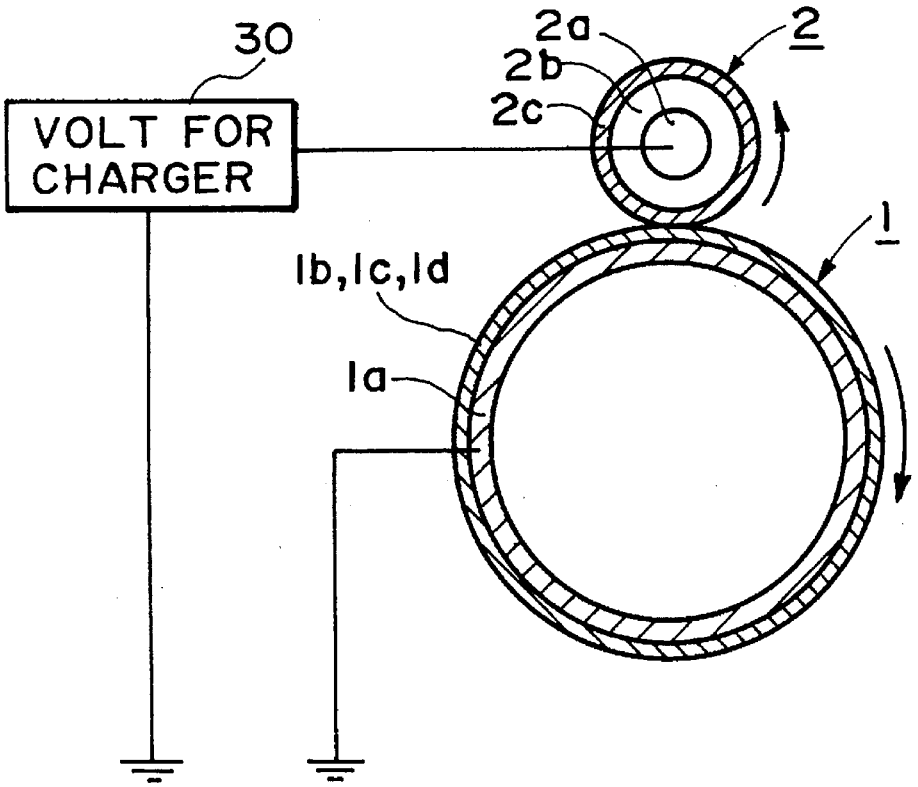
FIG. 3 is a schematic section of the laminar structure of a charge roller (solid roller).

FIG. 3 is a schematic section of the charge roller 2 as the charging member, depicting the laminar structure thereof. The charge roller 2 has a laminar structure comprising a metallic core 2*a*, an electrically conductive rubber layer 2*b*, and a high resistance layer 2*c* (epichlorohydrin rubber). The high resistance layer 2*c* is preferred to have a larger volumetric resistivity than the rubber layer 2*b*, so that leakage can be prevented.

The surface of the photosensitive drum 1 is charged to a predetermined potential $V_d$ using the AC charge system, that is, by applying from a power source 30 to the charge roller 2, an oscillating voltage composed of an AC voltage component in the form of a sine wave, and a DC voltage component.

The voltage applied in this embodiment was an oscillating voltage composed by superposing a DC voltage component and an AC voltage component, wherein the DC voltage component was a DC bias $V_{dc}$ having a voltage of −600 V, which is equivalent to the desired charge potential $V_d$, and the AC voltage component was an AC bias in the form of sine waves, which had a peak-to-peak voltage $V_{pp}$ of 1400 V, and a frequency of 700 Hz.

(4) Tests and researches

Preferable conditions for producing high quality images were studied for the photosensitive drum 1 as the image bearing member, and the charge roller 2 as the charging member, using the apparatus described above.

Figure 4:
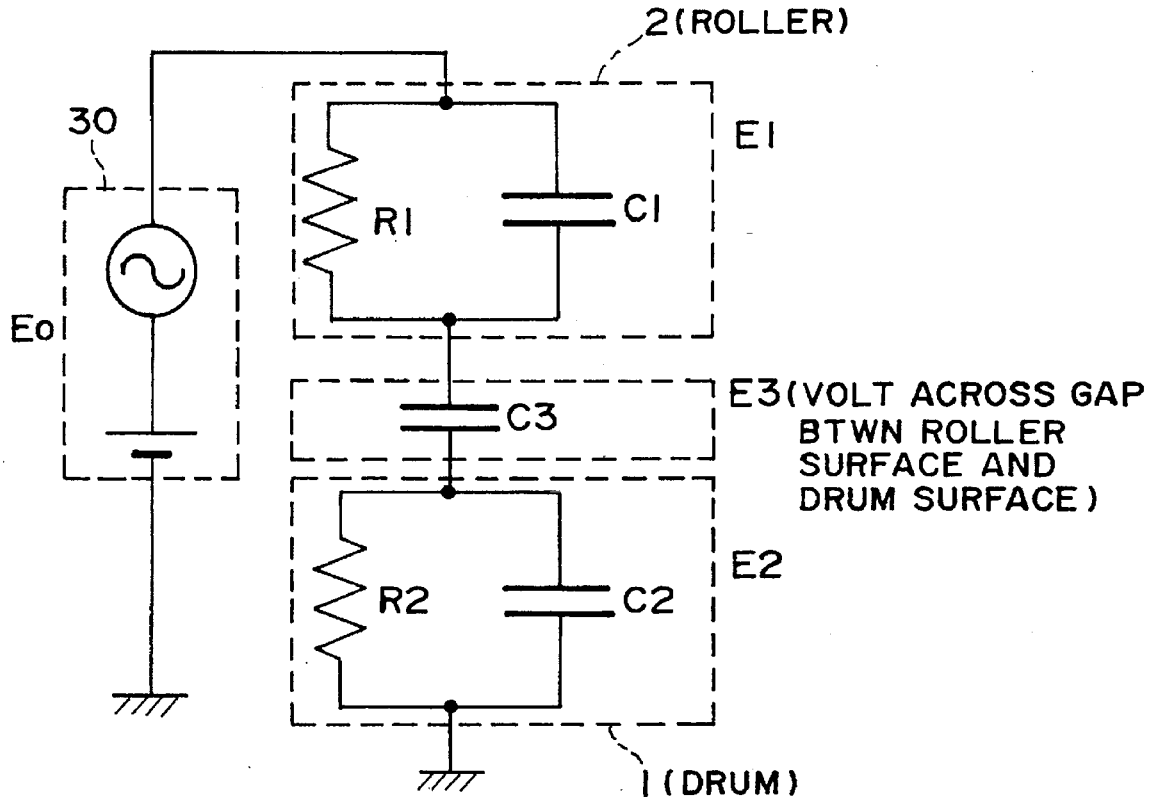

Incidentally, the peak-to-peak voltage $V_{gpp}$ of the AC voltage component applied between the charge roller surface and the photosensitive drum surface becomes smaller than the peak-to-peak voltage $V_{pp}$ applied to the metallic core 2*a* of the charge roller 2. The degree of this voltage attenuation varies depending on the AC impedance induced by the structure constituted of the charge roller 2, the photosensitive layer of the photosensitive drum 1, and the air layer between the charge roller 2 and the photosensitive layer. This will be described with reference to the equivalent circuit given in FIG. 4. In FIG. 4, the charge roller 2 and the photosensitive drum 1 can be considered to be the resistor and the condenser of a parallel circuit. The circuit equation given in FIG. 4 is solved in the following manner, wherein (f) stands for the frequency of the AC voltage applied to the metallic core 2*a* of the charge roller 2; ($V_{pp}$), the peak-to-peak voltage applied to the metallic core 2*b*; (W) stands for twice the AC amplitude of the voltage $E_3$ across the gap between the charge roller surface and the photosensitive drum surface ($W=V_{gpp}$).

$$W=[(Vpp/2-A)^2+B^2]^{1/2}$$

wherein $$A=Vpp/2\times C3\omega\{g2(\omega^2-\alpha\beta)+\omega^2C2(\alpha+\beta)\}/C4(\alpha^2+\omega^2)(\beta^2+\omega^2)$$

$$B=Vpp/2\times C3\omega^2\{C2(\omega^2-\alpha\beta)-g2(\alpha+\beta)\}/C4(\alpha^2+\omega^2)(\beta^2+\omega^2)$$

$$g1.2=1/R1.2$$

$$C4=C1C2+C2C3+C3C1$$

$$E0=Vpp/2\times\sin\omega t+EVdc$$

$$\alpha,\beta=-[\{(C2+C3)g1+(C1+C3)g2\}\pm[\{(C2+C3)g1+(C1+C3)g2\}^2-4C4g1g2]^{1/2}]/2C4$$

The values of the capacity $C_1$ of the charge roller 2, and the capacity $C_2$ of the photosensitive drum 1, the capacity $C_3$ of the air layer, and the resistances $R_1$ and $R_2$, can be measured; therefore, W (actual peak-to-peak voltage $V_{gpp}$ across the gap between the charge roller surface and the photosensitive drum surface) can be obtained.

Figure 5:
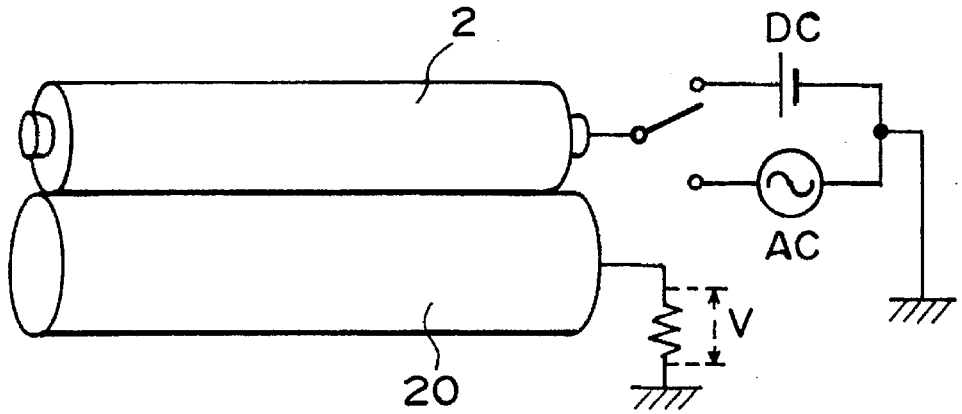
FIG. 5 is a drawing describing how the resistance and the capacity of the charge roller (or photosensitive drum) are measured.

The resistance $R_1$ and the capacity $C_1$ of the charge roller 2, and the resistance $R_1$ and the capacity $C_2$ of the photosensitive drum 1, are measured using the method shown in FIG. 5, wherein in place of the photosensitive drum 1, an aluminum drum 20 in the same form as the photosensitive drum 1 is placed in contact with the charge roller 2.

In other words, the resistance $R_1$ of the charge roller 2 is obtained by measuring the current flowing between the aluminum drum 20 as an electrode placed in contact with the charge roller 2, and the ground, while a DC bias of 400 V is applied to the charge roller 2.

As for the capacity $C_1$ of the charge roller 2, it is obtained as the combined capacity of the charge roller 2 and the air layer by measuring the current flowing between the aluminum drum 20 and the ground while an AC bias ($V_{pp}$=1400 V) is applied to the charge roller 2.

The capacity $C_3$ of the air layer is obtained n the following manner. That is, in place of the charge roller 2, an electrically conductive rubber, which has the same size as the charge roller 2, and whose volumetric resistance is substantially zero, is placed in contact with the aluminum drum 20, and the capacity $C_3$ is derived from the measured current flowing between the drum 20 and the ground while an AC bias ($V_{pp}$=1400 V) is applied to the rubber roller.

Next, the aluminum drum 20 in FIG. 5 is replaced with the photosensitive drum 1, and the combined resistance ($R_1+R_2$) as well as the combined capacity ($C_1+C_2+C_3$) are measured using the same procedure as the one described above. Then, the resistance $R_2$ and the capacity R3 of the photosensitive drum 1 are derived from the values of $C_1$, $C_3$ and $R_1$ obtained using the aluminum drum 20.

In this embodiment, the measured values were: charge roller 2:

$$R_1=6.1\times10^6\Omega$$

$$C_1=1.6\times10^{-9}\ F$$

photosensitive drum 1:

$$R_2=2.0\times10^9\Omega$$

$$C_2=4.0\times10^{-10}\ F$$

air:

$$C_3=3.5\times10^{-11}\ F$$

For example, when sine waves having a voltage of 1400 V and a frequency of 700 Hz were applied to the metallic core 2*a* of the charge roller 2, the practical peak-to-peak voltage W across the gap between the charge roller surface and the photosensitive drum surface was 1250 V.

Hereinafter, the present invention will be described with reference to the practical peak-to-peak voltage W across the gap between the surface of the charging member and the surface of the image bearing member.

(A) Image flow

Figure 6:
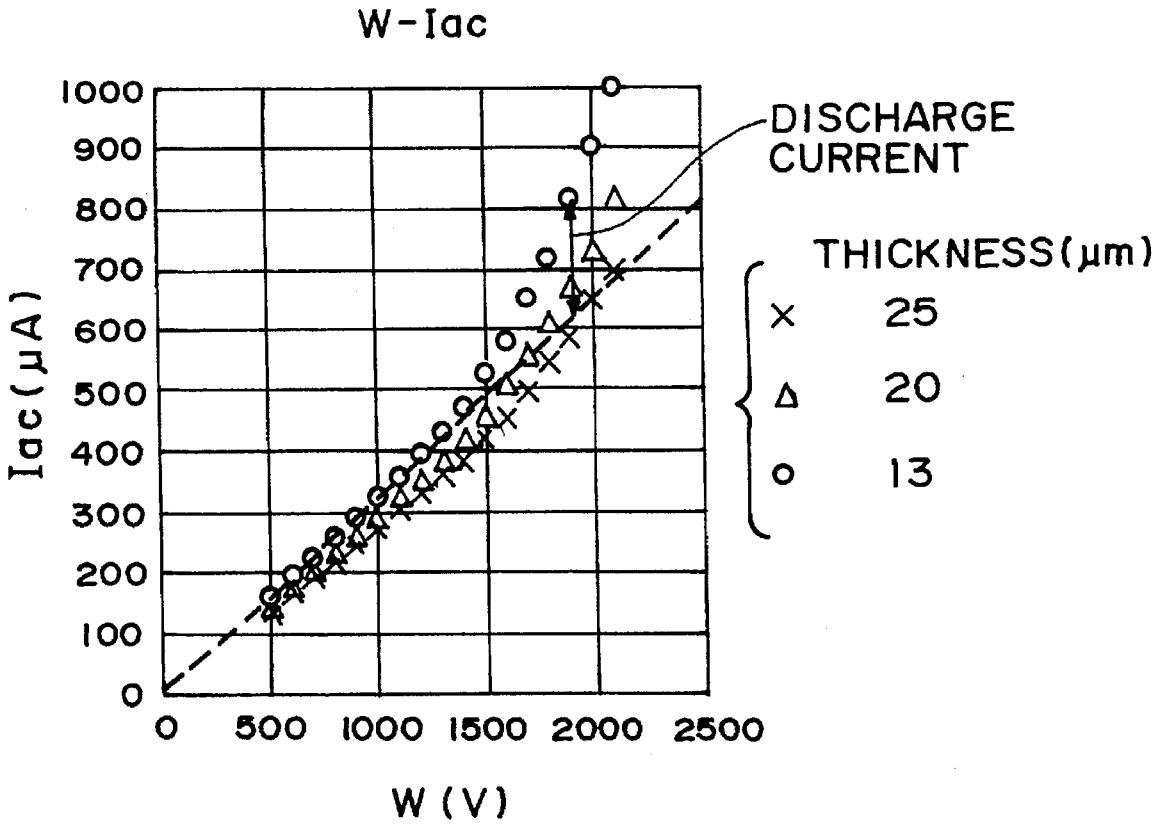
FIG. 6 is a graph showing the charge characteristics of the AC charge system (relationship between W and $I_{ac}$).

FIG. 6 shows the characteristics of three photosensitive drums whose dielectric layers (charge transfer layer+protection layer) had thicknesses of 13 μm, 20 μm and 25 μm, respectively, wherein the abscissa represents the aforementioned peak-to-peak voltage W, and the axis of ordinates represents the effective current value ($I_{ac}$).

In the case of any of the three photosensitive drums, as the voltage. increases, $I_{ac}$ linearly increases until W reaches approximately 1.1 kV ($2V_{gth}$, $V_{gth}$ being a discharge start value at which electrical discharge starts across the gap between the charging member surface and the photosensitive drum surface). The angles of these graphs represent the AC impedances created by the charge roller, the photosensitive drum, and the air layer between the charge roller and the photosensitive drum.

As W increases above approximately 1.1 kV, the angles of the graphs increase. The increase is attributable to the electrical discharge. It is evident from FIG. 6 that when W becomes larger, the amount of the current attributable to the electrical discharge increases regardless of the thickness of the dielectric layer of the photosensitive portion. This characteristic is particularly evident when W is above 1.6 kV.

As W increases, the image flow suddenly worsens, which seems to be correlated to the phenomenon described in the foregoing.

FIG. 7 shows the results of the endurance tests in which the image flow was checked while varying W under a high temperature-high humidity condition (32.5° C., 85% RH).

As for the endurance conditions, the tests were conducted for a duration of six days producing 1,000 copies a day. In FIG. 7, a white circle means that the image flow did not occur; a white triangle means that the image flow occurred but only slightly; and an x mark means that the image flow became conspicuous.

As is evident from FIG. 7, as long as W is kept below 1.6 kV during the charging process, the AC charge system can be used to charge the image bearing member without causing the image flow, regardless of the thickness of the dielectric layer of the photosensitive portion.

Further, the higher the surface resistance of the photosensitive drum, the less liable the image flow was to occur, and the lower the surface resistance of the photosensitive drum, the more liable the image flow was to occur. However, when W was kept below 1.6 kV, the image flow seldom occurred even when the resistance of the protection layer 1*d* was $10^{10}$ Ω.cm.

(B) Charge uniformity

When W across the gap between the charge roller surface and the photosensitive drum surface is no less than $2V_{gth}$, charge failure, or image defects such as the sandy-looking fog, do not occur. The thickness of the dielectric layer (charge transfer layer+protection layer) of the photosensitive drum and the discharge start voltage $V_{gth}$ (voltage at which the electrical discharge starts across the gap between the roller and the drum) have a relationship expressible by the following equations:

$$V_{gth}=(7737.6\times D)^{1/2}+312+6.2D$$

D=5/∈ (t: dielectric layer thickness [μm] of photosensitive portion, ∈: relative dielectric constant of dielectric layer)

Figure 8:
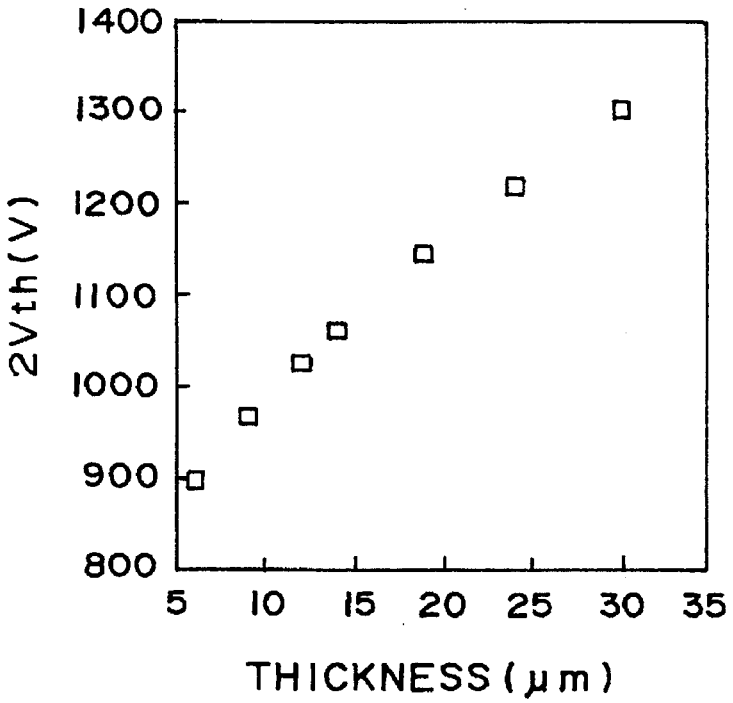
FIG. 8 is a graph showing the relationship between the thickness of the dielectric layer and the charge start voltage.

In other words, when the thickness of the photosensitive portion of the photosensitive drum is reduced, $V_{gth}$ decreases. The relationship between the dielectric layer thickness of the photosensitive portion, and $2V_{gth}$ is as shown in FIG. 8. In the case of the AC charge system, the image bearing member can be charged using a low W by reducing the dielectric layer thickness of the photosensitive portion.

The relationship between the dielectric layer thickness of the photosensitive portion, and charge uniformity, is also shown in FIG. 7. When W across the gap between the charge roller surface and the photosensitive drum surface is below $2V_{gth}$, charge failure and the sandy-looking fog occur.

Therefore, for the sake of the charge uniformity, it is preferable to satisfy:

$$W\geqq 2V_{gth}$$

In order to do so, the peak-to-peak voltage $V_{pp}$ of the AC voltage component applied to the charging member has only to be set at twice the charge start voltage of the photosensitive portion or more; the relationship between $V_{pp}$ and $V_{th}$ has only to satisfy:

$$V_{pp}\geqq 2V_{th}$$

Incidentally, $V_{th}$ designates the value of the DC voltage at which the photosensitive would begin to be charged if a DC voltage were applied to the charging member.

As is evident from FIG. 7, the charge uniformity can be accomplished at a smaller value of W when the dielectric layer thickness of the photosensitive portion is smaller than when it is larger.

(C) Shaving wear (frictional wear) and durability of photosensitive portion of photosensitive drum 1

In the case of a conventional photosensitive drum, it was shaved by 1.0 μm when 1,000 A4 size copies were printed, but in the case of a photosensitive drum having the protection layer 1*d* in accordance with the present invention, when the same test was conducted, it was shaved only by 0.1 μm, which was 1/10 the figure for the conventional photosensitive drum. This is due to the fact that the protection layer 1*d* had a smaller surface friction coefficient μ, and also was hard, being less liable to be shaved.

Therefore, the shaving which occurs when the photosensitive drum remains in use for along time is greatly reduced, making it possible to reduce the thickness of the high resistance layer of the photosensitive drum by a substantial margin. For example, a 30 μm thick high resistance layer which is necessary to give a conventional photosensitive drum a service life equivalent to 20,000 sheets of transfer material, can be replaced with a 13 μm thick photosensitive portion (10 μm thick charge transfer layer and 3 μm thick protection layer) in accordance with the present invention in order to give the same service life.

In other words, even when the thickness of the dielectric layer is reduced, a photosensitive drum provided with the protection layer 1*d* does not suffer from the durability related problem.

As is evident from the above description, the image flow, which occurs to a photosensitive drum having the protection layer 1*d* as the surface layer, can be prevented by suppressing the discharge current to a minimum, more specifically, by keeping the AC voltage component of the voltage applied to the charging member, in a range in which the practical peak-to-peak voltage $V_{gpp}$ across the gap between the charging member surface and the image bearing member remains no less than twice the discharge start voltage $V_{gth}$ of the gap between the charging. member surface and the image bearing member surface, but no more than 1600 V.

Incidentally, the AC voltage applied to the charging member may be placed under constant voltage control, or constant current control.

The charge start voltage $V_{gth}$ can be reduced by reducing the dielectric layer thickness of the image bearing member, whereby the $V_{gpp}$ at which charge failure occurs can be further reduced.

Further, the image bearing member having a protective layer as the surface layer is employed to reduce the image bearing member's frictional wear; therefore, even when the dielectric layer thickness of the image bearing member is reduced, the image bearing member does not suffer from the durability problem.

The contact type charging member in this embodiment was in the form of a roller. However, the form is not limited to the roller form; it is optional. For example, the charging member may be in the form of a blade or a brush.

Figure 9:
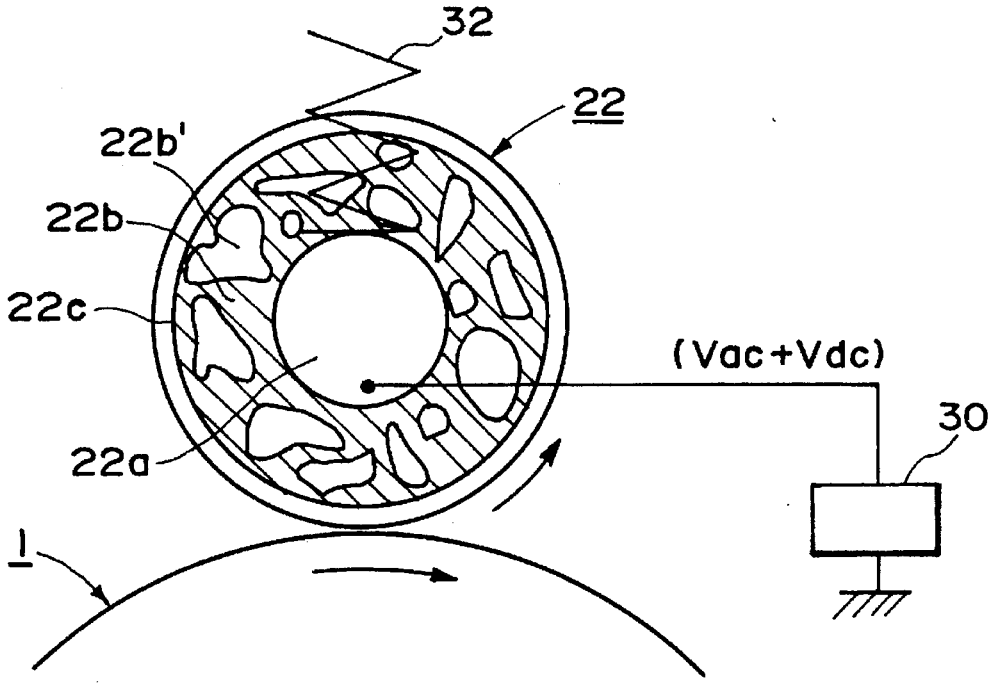
FIG. 9 is a schematic cross-section of the charge roller 9 (sponge roller) in the second embodiment of the present invention, showing the layers thereof.
Figure 10A:
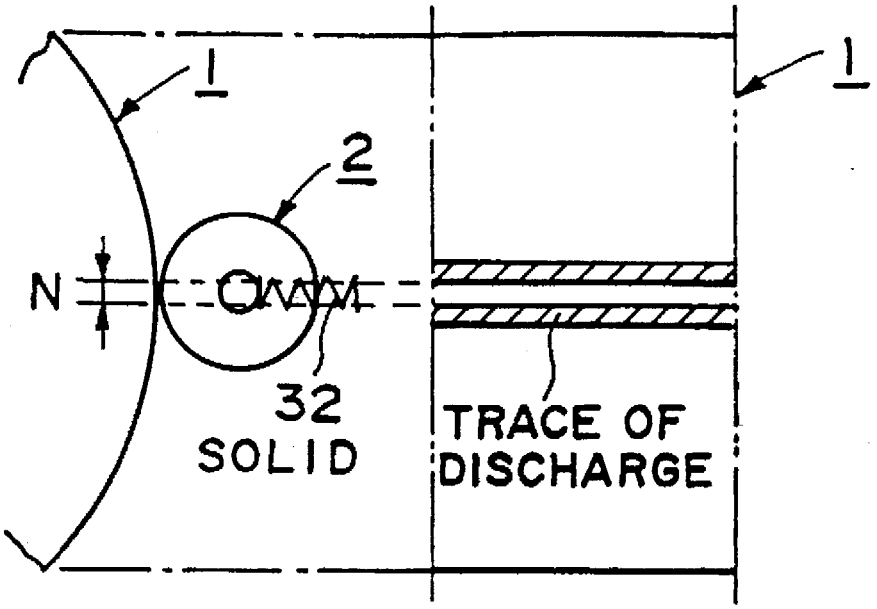
FIGS. 10(*a*) and 10(*b*) are drawings depicting the charging regions of the solid roller and the sponge roller, respectively, as the charging roller.
Figure 10B:
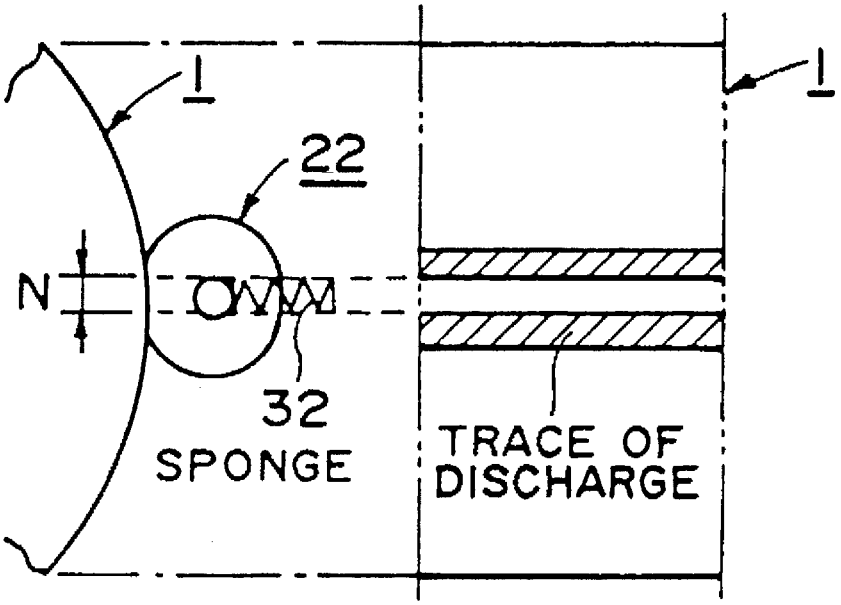

Embodiment 2 (FIGS. 9 and 10)

This embodiment is substantially the same as the first embodiment, except that the contact type charging member employed in the first embodiment Was replaced with another charging member in the form of a roller (charge roller). The charge roller in this embodiment comprised a foamed member supported by a supporting member, and a resistive layer which wrapped around the foamed member, and was placed in contact with the photosensitive drum as the image bearing member, directly, or indirectly through another layer.

FIG. 9 is a schematic section of the charge roller 22 in this embodiment, depicting the laminar structure thereof.

This charge roller 22 comprised: a metallic core 22*a* as the supporting member, which was made of metallic material such as stainless steel; an electrically conductive foamed member (foamed layer) 22*b*, which was formed on the peripheral surface of metallic core 22*a*, in the form of a roller concentric with the metallic core 22*a*; and a medium resistance layer 22*c*, which covered the peripheral surface of the foamed member in a wrapping manner.

The foamed member 22*b* was composed of a compound material created by dispersing powder of electrically conductive material such as carbon or tin oxide into foamable material such as polystyrene, polyolefin, polyester, polyurethane, or polyamide, in order to control the volumetric resistivity of the material. A reference numeral 22*b'* designates a pore portion (bubble in which air, nitrogen, argon gas, or the like has been sealed).

The medium resistance layer 22*c* is formed by extrusion, using fluorinated resin, styrene-butadiene rubber, or the like. As for fluorinated resin, urethane resin, polyester resin, polyethylene resin, PFA (perfluoroalkoxy), FEP (fluoroethylene-propylene), PTFE (polytetrafluoroethylene), EPDM, and the like, are available. Generally, these materials are extruded after powder of electrically conductive material is dispersed by kneading.

The specifications of the charge roller 22 in this embodiment was as follows:

metallic core 22*b:* round stainless rod with a diameter of 6.0 mm foamed member 22b:

carbon dispersed poly urethane foam (specific weight: 0.5 g/cm$^3$, volumetric resistivity 103 Ω.cm, thickness: 2.8 mm)

resistive layer 22c:

thermoplastic polyurethane elastomer (volumetric resistivity: $10^7$ Ω.cm, thickness: 250 μm)

The charge roller 22 with the above specifications was placed under the same control as the one employed in the first embodiment.

FIG. 10(*a*) shows the charge roller 2 of the first embodiment (hereinafter, solid roller), and a schematic drawing depicting the state of the contact between the solid roller 2 and the photosensitive drum 1, and the regions in which electrical discharge occurs. FIG. 10(*b*) shows the charge roller 22 of this embodiment (hereinafter, sponge roller), and a schematic drawing depicting the state of the contact between the sponge roller 22 and the photosensitive drum 1, and the regions in which electrical discharge occurs.

The charge roller 2 or 22 was kept stably in contact with the photosensitive drum 1 by a contact pressure generated by a spring 32. The solid roller 2 barely deformed, and the discharge occurred in both of the small gaps adjacent to the contact surface between the solid roller 2 and the photosensitive drum 1. On the other hand, the sponge roller 22 of this embodiment, being less hard, deformed so as to make the cross-section of the sponge roller 22 elliptic, on the contact surface side, increasing the size of the contact surface area (nip N) between the charge roller 22 and the photosensitive drum 1, and at the same time, reducing the curvature of the charge roller 22 relative to the photosensitive drum 1; therefore, the regions in which electrical discharge occurs expanded.

The discharge regions for the charge roller 2 or 22 were studied in the following manner. That is, while the charge roller was kept stationary, an AC bias was applied to leave the footprints of the discharge, which were observed with an optical microscope. The plan views of the regions as seen from above are given on the right-hand side of the drawings, the hatched portions being the discharge regions. As is evident from the drawings, it was confirmed that in the case of the sponge roller 22, the discharge regions expanded.

The above described effects increase the frequency of the electric discharge to the surface of the photosensitive drum 1, enabling the image bearing member to be uniformly chargeable by a low $V_{pp}$. Therefore, even when there are microscopic irregularities on the charge roller surface, or when the $V_{pp}$ applied to the charge roller is reduced, the image bearing member can be uniformly charged.

Figure 11A:
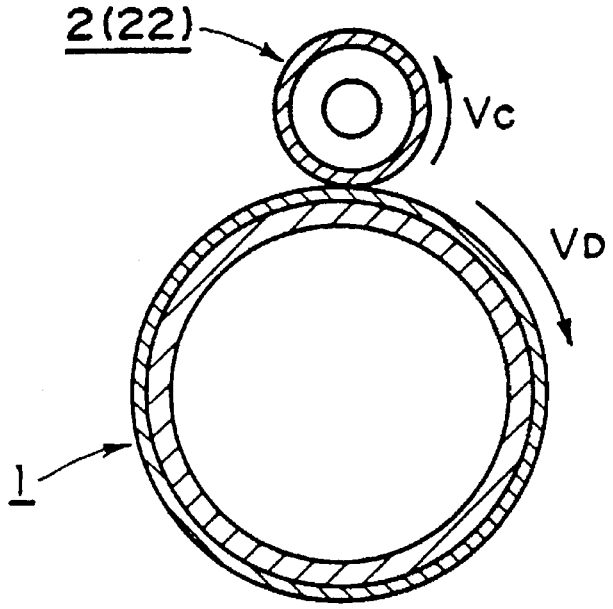
FIGS. 11(*a*) and 11(*b*) are explanatory drawings describing the difference between the peripheral velocity of the charge roller and that of the photosensitive drum.
Figure 11B:
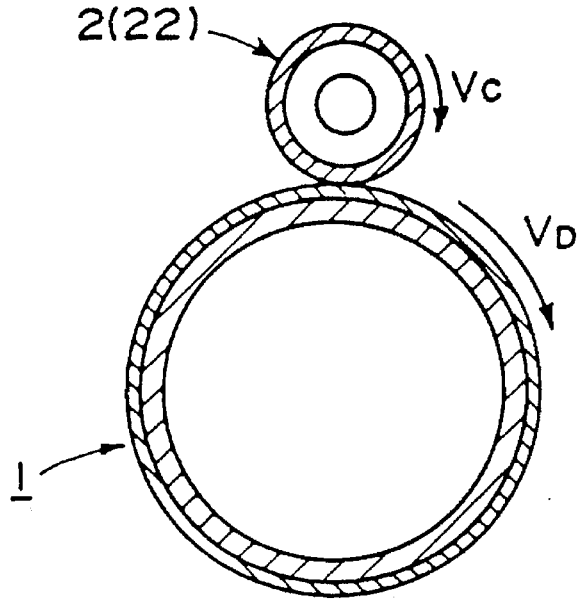

Embodiment 3 (FIG. 11).

This embodiment is also substantially the same as the first embodiment, except that the charge roller 2 as the contact type charging member was rotated so as to maintain a peripheral velocity difference between the charge roller 2 and the rotary photosensitive drum 1 as the image bearing member.

When there are microscopic irregularities on the charge roller surface, or when contaminant adheres to the charge roller, impedance is liable to increase. locally, which results in charge failure.

Therefore, in this embodiment, the charge roller 2 was rotated at a peripheral speed different from that of the photosensitive drum 1.

Referring to FIG. 11(*a*), the charge roller 2 was rotated at a peripheral velocity of $V_c$ which was 1.5 time the peripheral velocity $V_d$ of the photosensitive drum 1 ($V_c$=1.5×$V_d$), wherein the rotational direction of the charge roller 2 was such that the charge roller 2 moved in the same direction as the photosensitive drum 1, in the nip.

In the conventional arrangement, a given point of the photosensitive drum surface, which come in contact with a given point of the charge roller surface as it enters the nip, remain in contact with the same point of the charge roller surface while in the nip. However, according to this embodiment, a given point of the photosensitive drum surface, which also comes in contact with a given point of the charge roller surface at it enters the nip, does not remain in contact with the same point of the charge roller surface; it is forced to continuously come in contact with different points of the charge roller surface while in the nip. Therefore, even when there are microscopic irregularities, or even when contaminant adheres to the charge roller, the image bearing member can be uniformly charged.

In the case of the conventional photosensitive portion, the increase. in peripheral velocity of the charge roller 2 was attended with such ill effects that the torque had to be drastically increased, and the toner fused to the photosensitive drum 1.

However, in the case of the photosensitive portion in this embodiment, the surface friction coefficient μ of the photosensitive drum 1 was small. Therefore, the increase in the peripheral velocity of the charger roller 2 did not require as much torque increase as the increase for the conventional photosensitive drum, and the cleanability of the photosensitive drum was improved, preventing the toner fusion to the photosensitive drum surface. As a result, the charge uniformity was improved.

As for the peripheral velocity of the charge roller 2, the higher it is, the better the charge uniformity, but the amount of the required torque increases.

FIG. 11(*b*) depicts another arrangement in which the charge roller 2 was rotated so that the peripheral velocity difference between the charge roller 2 and the photosensitive drum 1 became 150%, wherein the rotational-direction of the charge roller 2 was reverse to that of the photosensitive drum 1, in the nip.

With this arrangement, the peripheral velocity ratio of the charge roller 2 relative to the photosensitive drum 1 can be increased to a ratio of 1.5 while allowing the velocity ratio of the charge roller 2 to the photosensitive drum 1, in terms of absolute number, to be reduced to a ratio of only 0.5.

The charge roller 2 may be driven by the photosensitive drum 1 by way of a gear, or may be independently driven by a motor not connected to the photosensitive drum 1.

Also in this embodiment, a given point of the photosensitive drum surface, which comes in contact with a given point of the charge roller surface at it enters the nip, does not remain in contact with the same point of the charge roller surface while in the nip; it is forced to continuously come in contact with different points of the charge roller surface while in the nip. Therefore, even when the $V_{pp}$ applied to the charge roller 2 was reduced, the charge uniformity was preferably maintained. Further, the peripheral velocity difference was created without being attended with such ill effects as the need for a higher rotational torque for the photosensitive drum 1 or the toner fusion.

When this embodiment is employed in conjunction with the charge roller (sponge roller) 22 of the second embodiment, much better results can be obtained, since the effects of the second embodiment synergistically add to the effect of this embodiment.

The peripheral velocity difference between the charge roller 2 (22) has only to be provided during the actual image formation process; when actual image formation is not going on, the rotation of the charge roller 2 (22) may be slaved to the rotation of photosensitive drum 1.

Figure 12:
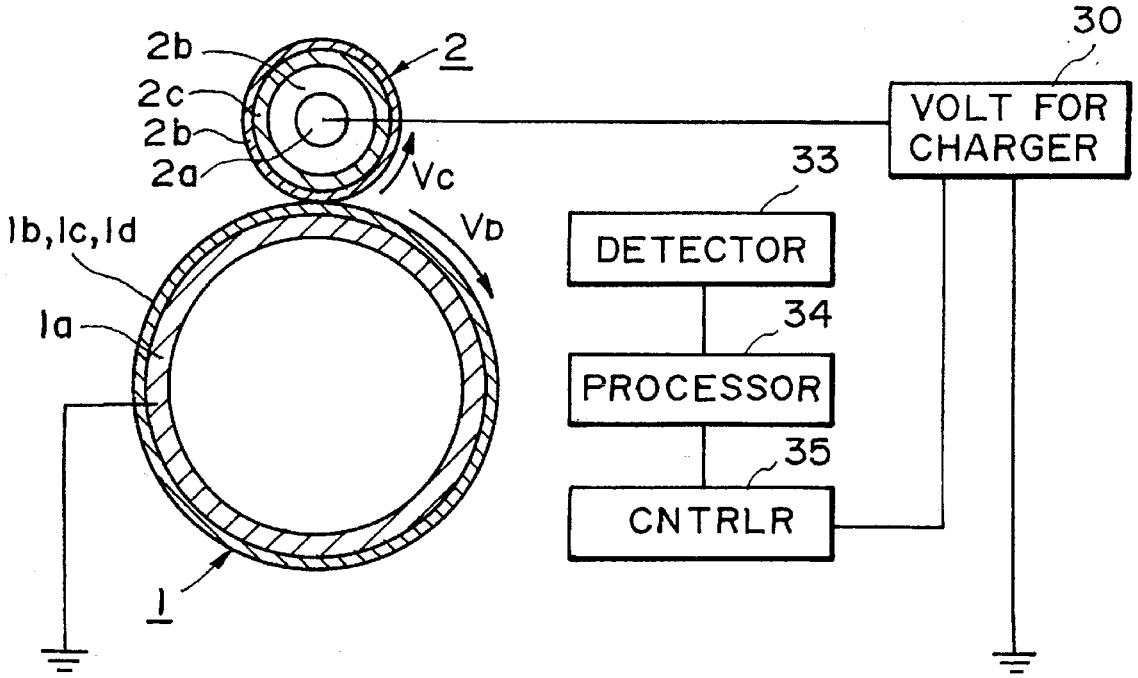
FIG. 12 is an explanatory drawing describing a first control system in the fourth embodiment of the present invention.
Figure 13:
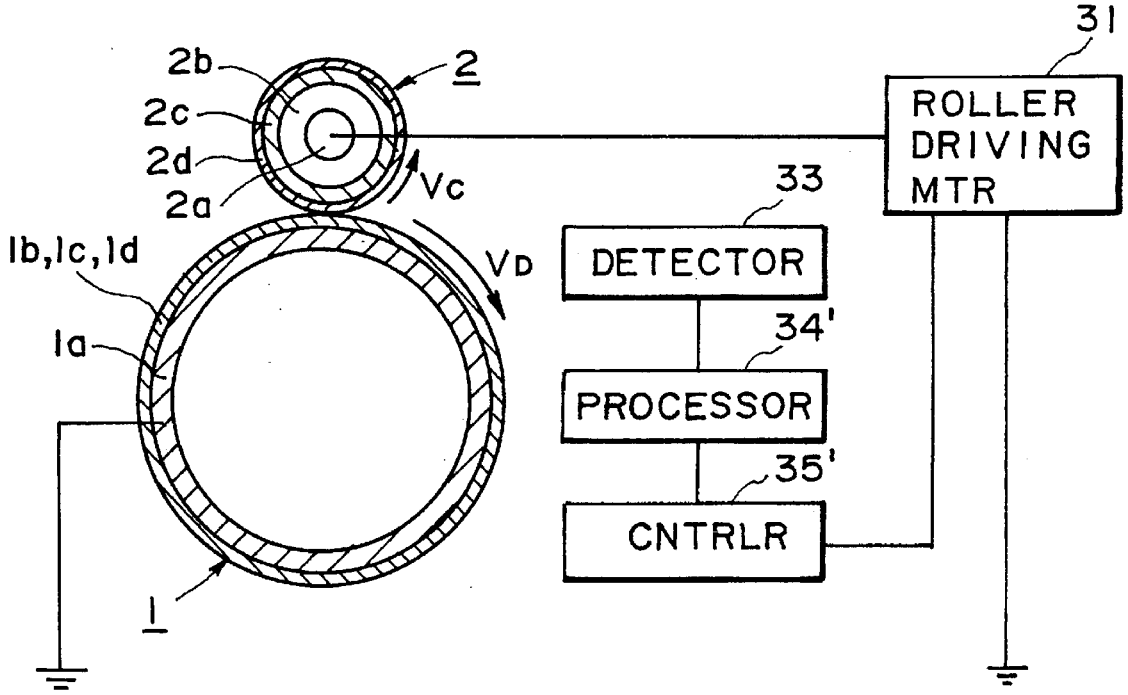
FIG. 13 is an explanatory drawing describing a second control system in the fourth embodiment of the present invention.
Figure 14:
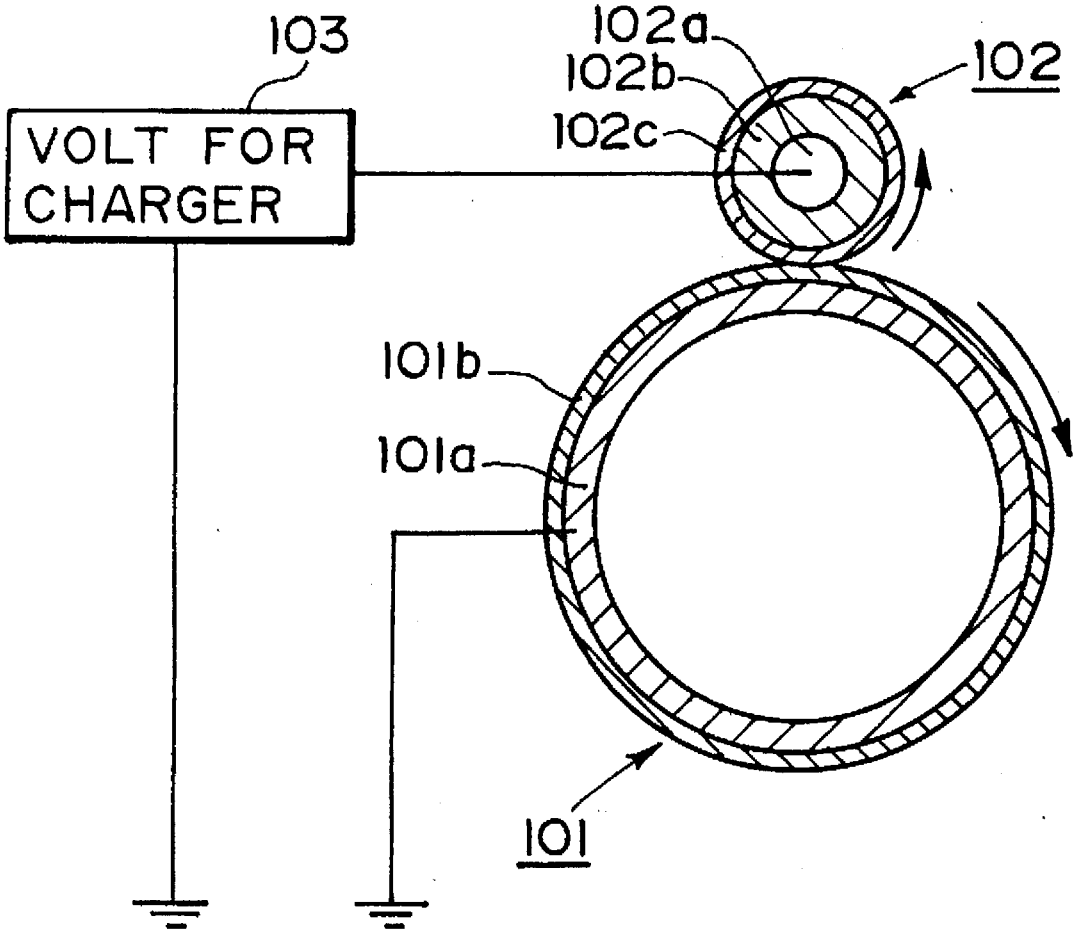
FIG. 14 is an explanatory drawing depicting the contact type charging apparatus.

Embodiment 4 (FIGS. 12 and 13)

This embodiment is substantially the same as the first to third embodiments, except that the temperature and/or the humidity of the environment in which an image forming apparatus was used were detected, and the obtained information was used to control the charging conditions so that the image bearing member could be optimally charged.

As described before, the image flow occurs because the products resulting from the AC discharge which occurs between the surface of the photosensitive drum 1 as the image bearing member, and the charge roller 2 as the charging member adhere to the surface of the photosensitive drum 1, and when humidity is high, the discharge products adhering to the surface of the photosensitive drum 1 absorb moisture, which reduces electrical resistance.

In a low humidity environment, even when the discharge products adhere to the surface of the photosensitive drum 1, the resistance does not decrease, making it unlikely for the image flow to occur. However in a low humidity environment, the resistance of the charge roller 2 tends to increase; therefore, when there are microscopic irregularities on the charge roller surface, or when contaminant adheres to the charge roller, impedance is liable to increase locally, which is liable to cause insufficient charge.

Thus, according to this embodiment, the temperature and/or the humidity of the environment in which an image forming apparatus is used are detected to control the charging conditions so that the image bearing member can be optimally charged.

FIG. 12 shows a first method of this embodiment. In this first method, the relative humidity of the environment in which an image forming apparatus was used was detected by a detecting portion 33, and the obtained results were compared with referential value (in this embodiment, 60%) by a computing portion 24. When the relative humidity was no less than 60%, the $V_{gpp}$ between the charge roller surface and the photosensitive drum surface was set to ($2V_{gth}$+100 V) using the $V_{gth}$ of the employed photosensitive drum. When the relative humidity was no more than 60%, the $V_{gpp}$ between the charge roller surface and the photosensitive drum surface was set to 1600 V. This method was carried out by a control portion 35 which controlled a power source from which a bias was applied to the charge roller 2.

FIG. 13 shows a second method of this embodiment. In this second method, control was executed so that the bias applied to the charge roller 2 was placed under the constant voltage control, and in a low temperature environment, the peripheral velocity $V_c$ of the charge roller 2 was increased. More specifically, the temperature was detected by a detecting portion 33, and the obtained temperature was compared with reference value (in this embodiment, 15° C.) in a computing portion 34'. When the temperature is no more than 15° C., the resistance of the charge roller 2 increases; therefore, charge uniformity is liable to be affected by the irregularity in resistance. Thus, in this embodiment, a motor 31 for driving the charge roller was controlled by a control portion 35' so that the charge roller was rotated at a peripheral velocity which was equivalent to 200% of the peripheral velocity $V_d$ of the photosensitive drum 1. When the temperature is no less than 15° C., that is, when the temperature is high, the charge uniformity is less liable to be affected by the resistance irregularity; therefore, in this embodiment, the motor 31 for driving the charge roller was controlled so that the charge roller was rotated at a peripheral velocity which was equivalent to 120% of the peripheral velocity $V_d$ of the. photosensitive drum 1. Both the temperature and the relative humidity may be detected.

Incidentally, the reference values for the temperature and the humidity, the values of the bias applied to the charge roller 2, and the peripheral velocity values, which were selected in this embodiment were simply examples; it is obvious that values other than those selected in this embodiment may be selected.

When control is executed as described above, high quality images can be more reliably obtained without being affected by the environment in which an image forming apparatus is used.

Others

The waveform of the AC voltage component in the contact type AC charge system is optional. It may be in the form of sine wave, rectangular wave, triangular wave, or the like. The AC voltage may be a voltage in the form of a rectangular wave, which is generated by periodically turning a DC current on and off. The aforementioned oscillating voltage created by superposing an AC voltage and a DC voltage may be created using only a DC power source (without using an AC power source).

The image bearing member does not need to be in the form of a drum; it may be in the form of an endless belt, a roll of web, or the like.

The process cartridge in accordance with the present invention comprises a minimum of an image bearing member, and a charging member which is placed in contact with the image bearing member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus, comprising:

a image bearing member comprising a photosensitive layer, a surface protection layer which comprises fluorine resin material;

a charging member contactable to said image bearing member to electrically charge said image bearing member, said charging member is being supplied with an oscillation voltage, and wherein a peak-to-peak voltage of the oscillating voltage applied across a gap between a surface of said charging member and the surface of said image bearing member, is not less than twice a charge starting voltage of said image bearing member in the gap and not more than 1600 volt.

2. An apparatus according to claim 1, wherein said surface protection layer comprises electroconductive particles.

3. An apparatus according to claim 1, wherein said charging member includes a base, a foam material supported on said base, and a resistance layer having a volume resistivity larger than that of said foam material and covering the foam material.

4. An apparatus according to claim 1, wherein a peripheral speed of said charging member and that of said image bearing member are different from each other.

5. An apparatus according to claim 1, wherein a movement direction of said charging member and that of said image bearing member are opposite at a contact portion therebetween.

6. An apparatus according to claim 1, further comprising detecting means for detecting at least one of temperature and humidity, and control means, responsive to an output of said detecting means, for controlling the peak-to-peak voltage.

7. An apparatus according to claim 1, further comprising detecting means for detecting at least one of temperature and humidity, and control means, responsive to an output of said detecting means, for controlling a difference in peripheral speeds between said charging member and said image bearing member.

8. An apparatus according to claim 1, wherein said charging member is in the form of a roller.

9. An apparatus according to claim 1, wherein said charging member and said image bearing member is mounted in a process cartridge detachably mountable on a main assembly of said image forming apparatus.

10. An apparatus according to claim 1, wherein a contact angle between the protection layer and water is not less tan 90 degrees.

* * * * *

UNITED STATES PATENT AND TRADEMARK OFFICE

CERTIFICATE OF CORRECTION

PATENT NO. : 5,666,606

DATED : September 9, 1997

INVENTORS : Keiji Okano, et al.

It is certified that error appears in the above-identified patent and that said Letters Patent is hereby corrected as shown below:

COLUMN 2

Line 2, "increased/the" should read --increased, the--.

COLUMN 3

Line 4, "photosensitive-drum" should read --photosensitive drum--.

COLUMN 5

Line 23, "photosensitive" (first occurrence) should read --The photosensitive--; and
Line 62, "drum i" should read --drum 1--.

COLUMN 6

Line 20, "then;" should read --then--; and
Line 24, "tridge.16" should read --tridge 16--.

UNITED STATES PATENT AND TRADEMARK OFFICE

CERTIFICATE OF CORRECTION

PATENT NO. : 5,666,606

DATED : September 9, 1997

INVENTORS : Keiji Okano, et al.

It is certified that error appears in the above-identified patent and that said Letters Patent is hereby corrected as shown below:

COLUMN 8

Line 6, "improve," should read --improve--.

COLUMN 9

Line 45, "n the" should read --in the--;
Line 60, "charge" should be deleted; and
Line 61, "roller" should read --charge roller--.

COLUMN 10

Line 25, "voltage." should read --voltage--.

COLUMN 11

Line 36, "photosensitive" should read --photosensitive portion--; and
Line 54, "along" should read -- a long--.

COLUMN 12

Line 32, "Was" should read --was--.

UNITED STATES PATENT AND TRADEMARK OFFICE

CERTIFICATE OF CORRECTION

PATENT NO. : 5,666,606

DATED : September 9, 1997

INVENTORS : Keiji Okano, et al.

It is certified that error appears in the above-identified patent and that said Letters Patent is hereby corrected as shown below:

COLUMN 14

Line 38, "rotational-" should read --rotational--.

Signed and Sealed this

Fourteenth Day of April, 1998

Bruce Lehman

*Attest:*

BRUCE LEHMAN

*Attesting Officer*

*Commissioner of Patents and Trademarks*